US010533343B2

(12) United States Patent
Gartner

(10) Patent No.: US 10,533,343 B2
(45) Date of Patent: Jan. 14, 2020

(54) ELECTRONIC AND MECHANICAL COMBINATION LOCK

(71) Applicant: MG TECH CENTER BV H.O.D.N. LOCK TECHNOLOGY, Ulft (NL)

(72) Inventor: Klaus W. Gartner, Palos Verdes Estates, CA (US)

(73) Assignee: MG TECH CENTER BV H.O.D.N. LOCK TECHNOLOGY, Ulft (NL)

( * ) Notice: Subject to any disclaimer, the term of this patent is extended or adjusted under 35 U.S.C. 154(b) by 107 days.

(21) Appl. No.: 15/549,331

(22) PCT Filed: Feb. 17, 2015

(86) PCT No.: PCT/US2015/016129
§ 371 (c)(1),
(2) Date: Aug. 7, 2017

(87) PCT Pub. No.: WO2016/130164
PCT Pub. Date: Aug. 18, 2016

(65) Prior Publication Data

US 2018/0058102 A1 Mar. 1, 2018

Related U.S. Application Data

(60) Provisional application No. 62/088,140, filed on Feb. 9, 2015.

(51) Int. Cl.
*E05B 47/00* (2006.01)
*E05B 17/20* (2006.01)
(Continued)

(52) U.S. Cl.
CPC ..... *E05B 47/0005* (2013.01); *E05B 37/0034* (2013.01); *E05B 37/08* (2013.01);
(Continued)

(58) Field of Classification Search
CPC ..... E05B 17/20; E05B 17/208; E05B 37/00; E05B 37/0031; E05B 37/0034;
(Continued)

(56) References Cited

U.S. PATENT DOCUMENTS 4,831,851 A * 5/1989 Larson ..... E05B 47/0002 70/277
4,899,562 A 2/1990 Gartner et al.
(Continued)

OTHER PUBLICATIONS

International Search Report and Written Opinion, issued by the ISA/US United States Receiving Office, regarding corresponding patent application Serial No. PCT/US2015/016129, dated May 19, 2015, 8 pages.
(Continued)

*Primary Examiner* — Christopher J Boswell
(74) *Attorney, Agent, or Firm* — Fox Rothschild LLP

(57) ABSTRACT

A lock including a housing and an opening for receiving a locking bolt moveable between a locked position and an unlocked position is provided. The lock also includes a rotary actuator having a rotary output of a predetermined amount and responsive to entry of an electronic combination input by a user; a cam wheel operably coupled to the housing and responsive to a manual combination input of the user, the cam wheel including a cam way; a bolt release lever moveably coupled to the housing and including a nose portion engageable with the cam way and a locking bar; and an armature post responsive to both the rotary and manual inputs, the armature post moveable between a blocking position for blocking the locking bolt in the locked position and an unblocking position for allowing the locking bolt to move into the unlocked position.

15 Claims, 10 Drawing Sheets

(51) Int. Cl.

| | |
|---|---|
| ***E05B 47/06*** | (2006.01) |
| ***E05B 37/00*** | (2006.01) |
| ***E05B 37/08*** | (2006.01) |
| ***E05B 47/02*** | (2006.01) |

(52) U.S. Cl.
CPC ..... *E05B 47/0012* (2013.01); *E05B 47/023* (2013.01); *E05B 47/0607* (2013.01); *E05B 17/208* (2013.01); *E05B 2047/0085* (2013.01)

(58) Field of Classification Search
CPC ..... E05B 37/08; E05B 47/00; E05B 47/0005; E05B 47/0012; E05B 47/02; E05B 47/023; E05B 47/06; E05B 47/0607; E05B 2047/0017; E05B 2047/0037; E05B 2047/0085
See application file for complete search history.

(56) References Cited

U.S. PATENT DOCUMENTS

| | | | | | |
|---|---|---|---|---|---|
| 4,967,577 | A * | 11/1990 | Gartner | E05B 37/08 | 70/279.1 |
| 5,134,870 | A | 8/1992 | Uyeda et al. | | |
| 5,307,656 | A | 5/1994 | Gartner et al. | | |
| 5,542,272 | A * | 8/1996 | Heinemann | E05B 37/00 | 70/133 |
| 5,893,283 | A * | 4/1999 | Evans | E05B 37/00 | 70/278.7 |
| 6,006,561 | A * | 12/1999 | Hill | E05B 47/00 | 70/276 |
| 6,098,433 | A | 8/2000 | Maniaci | | |
| 6,341,513 | B1 * | 1/2002 | Chen | E05B 37/00 | 70/279.1 |
| 6,786,519 | B2 * | 9/2004 | Gartner | E05B 17/2034 | 109/59 R |
| 7,770,944 | B2 * | 8/2010 | Yuan | E05B 47/0012 | 292/195 |
| 9,080,349 | B2 * | 7/2015 | Burrus | E05B 37/00 | |
| 9,458,647 | B2 * | 10/2016 | Gartner | E05B 17/2092 | |
| 9,657,500 | B2 * | 5/2017 | Min | E05B 47/00 | |
| 9,822,555 | B2 * | 11/2017 | Min | E05B 17/208 | |
| 2008/0276672 | A1 | 11/2008 | Gartner | | |
| 2016/0244995 | A1 * | 8/2016 | Gartner | E05B 49/00 | |

OTHER PUBLICATIONS

China First Office Action, issued by the State Intellectual Property Office of P.R. China, regarding corresponding patent Application No. CN 201580023809.9; dated Jun. 4, 2018, 9 pages (with translation).

Extended European Search Report, issued by the European Patent Office, regarding corresponding patent application Serial No. EP 15882245.2, dated Sep. 11, 2018; 6 pages.

* cited by examiner

ELECTRONIC AND MECHANICAL COMBINATION LOCK

CROSS REFERENCE TO RELATED APPLICATIONS

This application is a national stage patent application of International patent application Serial No.: PCT/US2015/016129, filed on Feb. 17, 2015; which claims the benefit of U.S. Provisional patent application Ser. No. 62/088,140, filed on Feb. 9, 2015; the entireties of which are hereby incorporated by reference.

FIELD OF THE INVENTION

The present invention relates generally to an electronic and mechanical combination lock. In particular the invention relates to a lock that can be opened by either electronic or manual means.

BACKGROUND OF THE INVENTION

Safes and other secure containers have traditionally used combination locks for controlling and authorizing entry. Early locks were entirely mechanical and relied on a person dialing a correct combination on a rotating dial. Rotation of the dial positioned mechanical elements within the lock such that dialing the correct combination allowed a locking bolt to release the container door. Proper dial rotation aligned gates in tumblers. Once the gates were aligned, a fence on a fence lever entered the aligned gates. Continued rotation of the dial and tumblers pulled the fence lever and withdrew the bolt.

However, over the years electromechanical locks have gradually replaced the mechanical locks described above. Indeed, electromechanical locks themselves have seen many improvements over the years. The use of sophisticated electronic logic circuitry has enabled the implementation of a series of complex and unique electronic combinations which has made improper entry into secured areas more difficult. When the lock is used to secure entry to a container, the electronic components are typically mounted within a housing inside the container door. The housing contains an actuating device and a circuit board. The electronic key pad transmits a signal to the circuit board, which contains the electronic circuitry that allows the lock to open and close. The keypad is located on the outside of the housing so as to be accessible to the user. A cable typically extends between the keypad and the circuit board for transmitting signals between the two components.

In addition to the electronic circuitry, electromechanical locks include a bolt. The bolt is movably constructed and is coupled to a bolt-displacing device enabling a user to selectively move the bolt into one of at least two end positions by means of the actuating device. The lock is blocked and therefore "locked" in a first end position of the bolt and unblocked or "open" and "unlocked" in a second end position of the bolt. When the user enters the correct combination into an electronic keypad, a signal is transmitted to the circuit board. The circuit board in turn actuates the actuating device, which allows the locking bolt to move to the unlocked position within the housing, thus allowing the user to open the safe door.

Although known electronic locks have proven effective in everyday practical use, there is a need for improvement, particularly with regard to design. For example, electrical surges in the power line supplying power to the electronic lock can damage the circuitry making impossible the opening of the lock by the authorized user. The resultant cost to have the safe or secured area opened could be significant in light of the materials used for the enclosure and the difficulty in gaining entry by cutting through those materials. In addition, malfunction could also result from tampering, or loss of power making opening of the lock impossible.

Accordingly, there is a need for a combination mechanical and electronic lock that is simple to assemble, cost efficient, and that can reliably block access to a container by unauthorized users.

BRIEF SUMMARY OF THE INVENTION

The problems outlined above are addressed by the electronic and mechanical combination lock in accordance with the invention. The electronic and mechanical combination lock in accordance with the invention provides for a manual mechanical means and an electronic means for opening the lock. The manual mechanical means and the electronic means are mounted on a dial, which is mounted outside the container to be protected.

The dial includes a key pad having a series of electronic numbers, typically from 1-9 and 0 which, when contacted by a user entering the correct combination, will generate an electronic signal to rotary means. The rotary means, which may be a solenoid, is coupled to an armature post having a first blocking member in blocking contact with a locking bolt. The armature post also includes a second outwardly extending armature post member described in detail below. Upon receiving the electronic signal the solenoid causes the armature post to rotate to an unlocked position that enables the locking bolt to by-pass the blocking member allowing the authorized user to open the lock.

The manual mode of opening of the lock includes a dial-operated plurality of tumbler wheels having gates to receive a fence member of a bolt operating release mechanism when the manual combination is correctly dialed.

A bolt operating release mechanism has three components assembled as one unit which interacts with the dial and tumblers above, and a dial operated cam. The bolt operating lever includes a nose portion at a first end that engagingly meshes with the cam and an opposite second end pivotally attached to a housing. The second end includes an outwardly extending engagement lever that contacts the second outwardly extending member on the armature post.

Upon entry of the correct manual combination, the nose portion engages the cam causing the second end of the bolt operating lever to pivot causing the outwardly extending engagement lever to push against the second outwardly extending member on the armature post in turn causing the armature post to rotate. As the armature post rotates the first block member moves to the unlocked position which allows the locking bolt to move to the unlocked position.

In one aspect of the invention a lock including a housing having an opening for receiving a locking bolt being movable between a locked position and an unlocked position is provided. The lock includes a dual input dial having an electronic digital keypad for electronic entry of a combination and a mechanical dial for manual entry of a combination; a rotary actuator positioned within the housing and energizable between a locked condition for maintaining the locking bolt in the locked position and an unlocked condition that allows the locking bolt to move to the unlocked position; a cam wheel operably coupled to the housing, the cam wheel including a cam way; a bolt release lever moveably coupled to the housing, the bolt release lever having a nose portion engageable with said cam way and a locking bar; and an armature post operably coupled to the rotary actuator, said armature post including first and second outwardly extending flanges, said first outwardly extending flange normally biased in a blocking position to block said locking bolt from being moved to the unlocked position, Upon actuation, the rotary actuator causes the armature post to rotate by a predetermined amount in which the first outwardly extending flange rotatably moves from the blocking position to an unblocking position allowing the locking bolt to move into the unlocked position. Additionally, when the nose portion engages said cam way the locking bar moves downward by a predetermined amount to rotatably move the second outwardly extending flange and cause the first outwardly extending flange to move from the blocking position to an unblocking position allowing the locking bolt to move into the unlocked position.

In another aspect of the invention, a lock including a housing having a cavity with first and second opposing side walls and an opening for receiving a locking bolt, the locking bolt moveable between a locked position and an unlocked position is provided. The lock also includes a rotary actuator having a rotary output of a predetermined amount and responsive to entry of an electronic combination input by a user; a cam wheel operably coupled to the housing and responsive to a manual combination input of the user, the cam wheel including a cam way; a bolt release lever moveably coupled to the housing, the bolt release lever including a nose portion engageable with the cam way and a locking bar; and an armature post responsive to both of the rotary output and the manual input, the armature post moveable between a blocking position for blocking the locking bolt in the locked position and an unblocking position for allowing the locking bolt to move into the unlocked position.

The armature post in accordance with the invention includes a first blocking member responsive to the rotary output for blocking the locking bolt in the locked position and a second outwardly extending flange member rotatably responsive to a downward movement of the bolt release lever to cause the first blocking member to move to the unblocking position.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF THE INVENTION

Swing bolt or rotary bolt locking devices mount a bolt for pivoting between locked and unlocked positions. This application refers to the swing bolt within the locking device as the "bolt," "swing bolt," or "locking bolt." The bolts that secure the safe door to the rest of the safe are called "safe bolts." In the locked position, part of the locking bolt projects out of the housing and interferes with a portion of the mechanical bolt works, thereby preventing the bolt works from moving the safe bolts to the unlocked position. When the user enters the correct combination, the lock mechanism allows the locking bolt to pivot to the unlocked position within the housing.

In general, a handle on the outside of the safe connects to the bolt works. Rotating the handle initiates movement of the bolt works. If the user enters the correct combination which unlocks or releases the locking bolt, as noted above, the bolt works can pivot the rotary bolt so that the rotary bolt does not project from the housing. This unlocked position permits the bolt works to continue moving the safe bolts to the unlocked condition, allowing the operator to open the safe.

Figure 1:
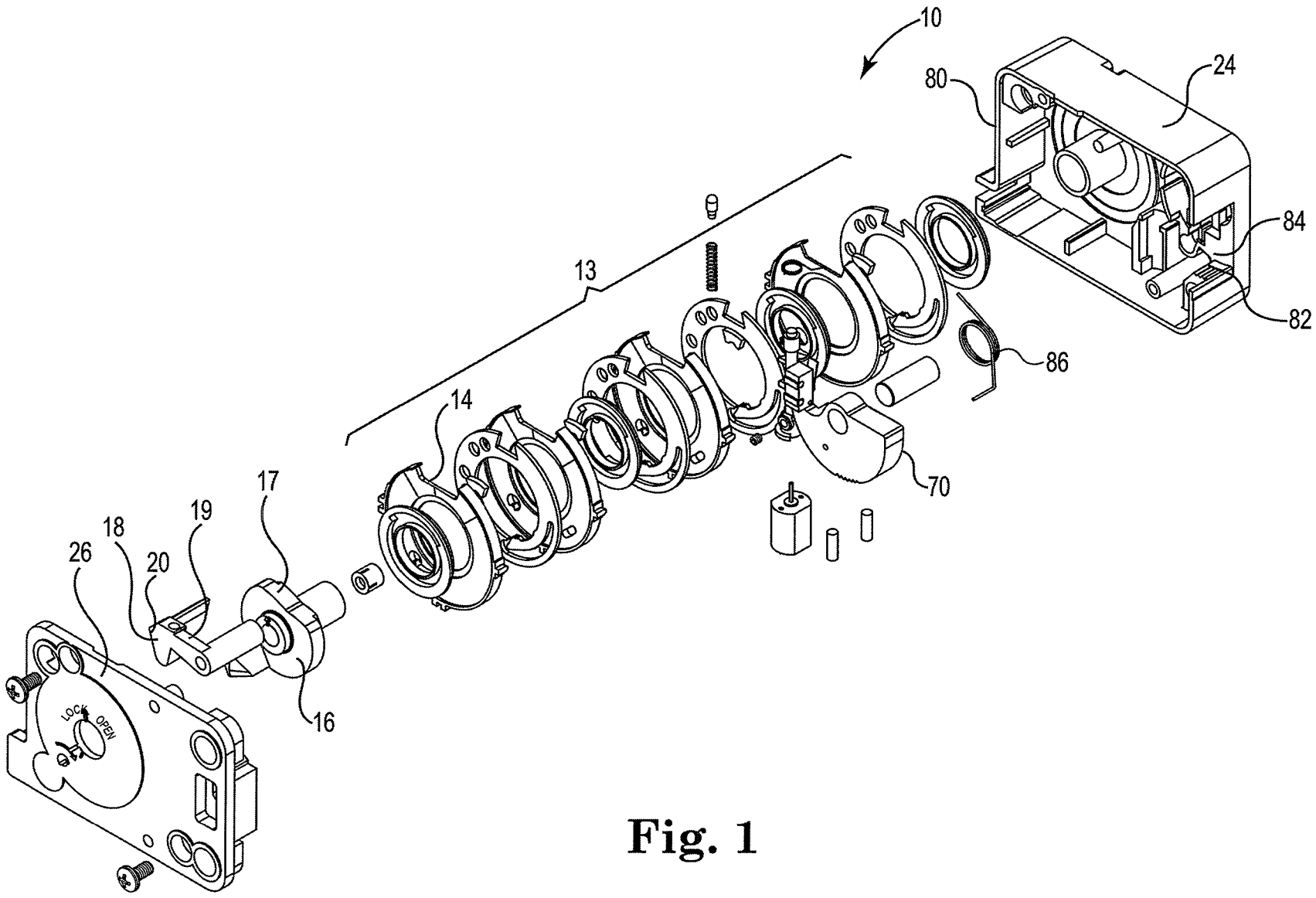
FIG. 1 is an exploded view of the lock in accordance with the invention showing the face plate and housing.
Figure 2:
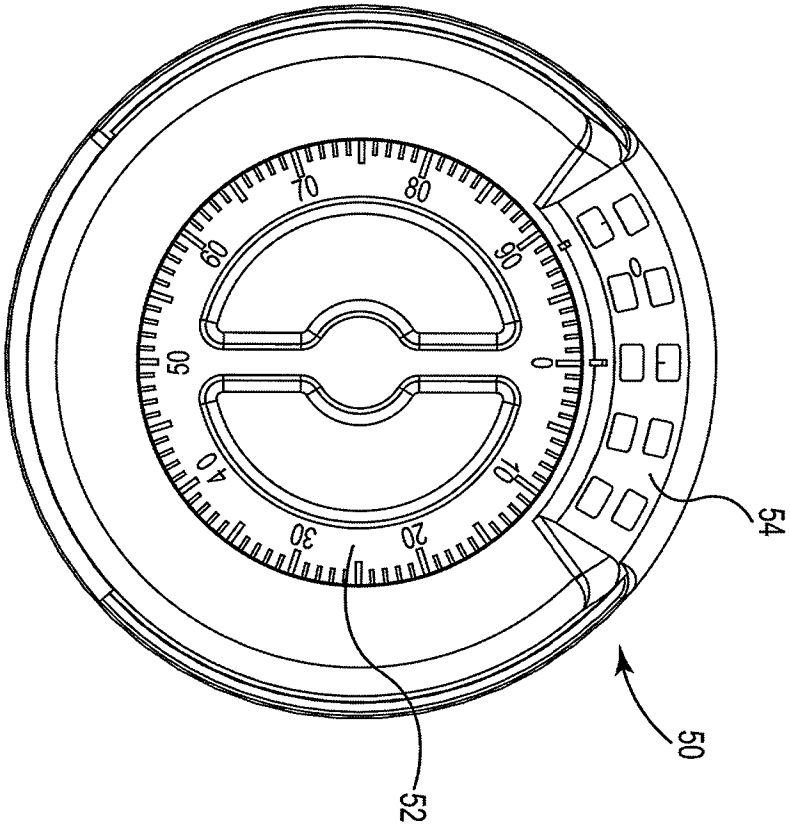
FIG. 2 is an exemplary dial in accordance with the invention having both manual and electronic components.

Referring now to FIG. 1 the electronic and mechanical combination lock 10 in accordance with the invention is shown. The electronic and mechanical combination lock is mounted to a wall 22 (as best seen in FIGS. 4-9) which is representative of the door of a container, a safe or security room, or portions of a wall adjacent to such doors. A dual input dial, as best seen in FIG. 2, is mounted on a forward side of the wall 22. The dual input dial is capable of accepting an electronic entry combination or a manual entry combination (i.e. by rotating the dial to the left and right to enter the correct number).

Housing 24 of lock 10 includes faceplate 26 and first and second opposing side walls 80, 82 including opening 84 for receiving a locking bolt 70. In one aspect of the invention, a plurality of gated tumbler wheels 13 each having a gate 14 thereon, are provided within the lock housing 24 in a manner to be manipulated by the manual lock portion 52 of dial 50, seen in FIG. 2, via the dial shaft 150 seen in FIG. 3.

A cam wheel 16 which engages with dial shaft 15 is provided with a cam way 17 which receives the nose portion 18 of bolt release lever 19 when the associated fence 20 (best seen in FIGS. 4-9) is received in the aligned gates 14 of the tumbler wheels 13. The bolt release lever 19 is pivotally connected at its second end by pin 21 to housing 24. The second end of bolt release lever 19 includes an locking bar 25 that contacts the second outwardly extending member 36 on the armature post 30 as will hereinafter be described in additional detail below.

Referring now to FIG. 1, a locking bolt 70 mounts in housing 12. In the present embodiment, locking bolt 70 is a rotary bolt having a generally D-shape in cross-section. However, it should be understood that various other shapes of locking bolt 70 are contemplated and within the intended scope of the present invention. A shaft receiving opening 42 is positioned near the center of rotary bolt 70. Shaft receiving opening 42 is configured to receive a shaft or axle that mounts within the housing 24. Shaft 43 mounts in first and second sleeves (not shown) located on the inside walls of housing 24. Shaft receiving opening 42 is generally round and has a diameter that is slightly larger than the diameter of shaft 43. Shaft receiving opening 42 of locking bolt 40 fits onto shaft 43, allowing locking bolt 40 to rotate about the shaft. Thus, a bearing means is formed between opening 42 of locking bolt 40 and shaft 43, which remains generally stationary as locking bolt 40 rotates.

Figure 4:
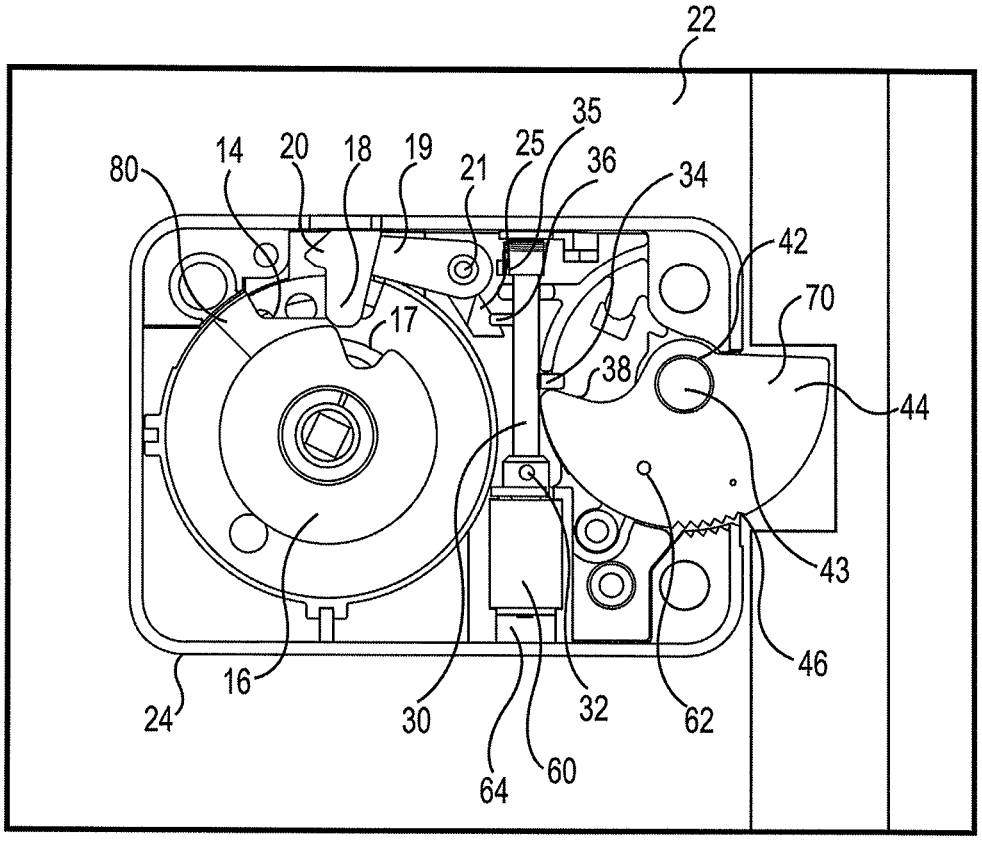
FIG. 4 is a top view of the lock in accordance with the invention showing the lock in the locked position.

Locking bolt 70 is illustrated in FIG. 4 in a locked position. In the locked position, extended portion 44 of locking bolt 70 extends outside locking bolt opening 46. Locking bolt opening 46 is an indentation in the top wall of housing 24 that is typically formed when the housing is cast. In operation, locking bolt 70 rotates to an unlocked position in which extended portion 44 of locking bolt 70 retracts within housing 24. The movement of locking bolt 70 between the locked and unlocked positions will be described in more detail hereinafter.

Figure 10:
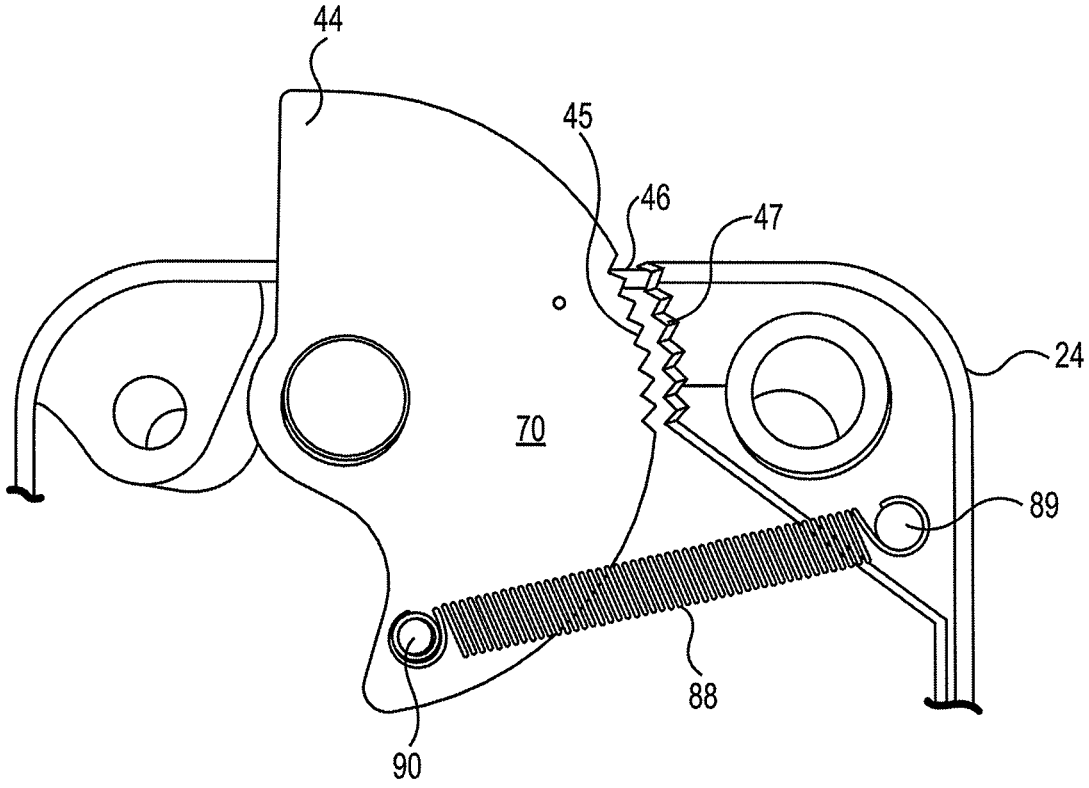
FIG. 10 is a top view showing one alternative for biasing the locking bolt in the locked position.

As seen in FIG. 1, a leaf spring 86 is positioned between the bolt and the housing and biases the bolt in the locked position. In an alternative embodiment, as seen in FIG. 10, compression spring 88 stretches from a pin 89 that is located on the inside wall of housing 24 to another pin 90 positioned on the back side of locking bolt 70. In each case, tension from the spring 86, 88 biases locking bolt 70 counterclockwise with extended portion 44 of bolt 70 in the locked position extended outside the housing 24.

As may also be seen in FIG. 10 the locking bolt may include an optional tamper resistant mechanism comprising a plurality of teeth 45 in the locking bolt 70 and a plurality of corresponding teeth 47 in the housing 24. Attempting to forcibly rotate the locking bolt 70 from the locked position, as best seen in FIG. 10, to the unlocked position while the actuator is in the locked condition causes the plurality of teeth on the locking bolt to engage with the teeth 47 in the housing 24 preventing unauthorized entry.

Actuator 60 mounts inside housing 24. Many different types of actuators may be used including, but not limited to, motors, rotary solenoids, electronic and mechanical rotary devices, and electromagnetic rotary devices. For purposes of example, actuator 60 will be described as a rotary solenoid throughout the remainder of this disclosure. Rotary solenoid 60 mounts in a cavity 64 within housing 24, which is formed by several walls extending upward from the inside wall of housing 24. The walls forming cavity 64 are typically part of the casting that forms housing 24. Attached to rotary solenoid 60 via a rotary shaft is an armature post 30.

Armature post 30 includes first 32 and second 35 ends thereof. First end 32 is rotatably coupled to rotary solenoid 60. Armature post 30 also includes first and second outwardly extending members 34, 36. In the locked position, first outwardly extending member 34 contacts the lip portion 38 of swing bolt 70 and functions as a stop preventing swing bolt 70 from moving into the unlocked position by retracting into housing 24. The second outwardly extending member 36 is spaced apart from the first outwardly extending member 34 and is in contact with locking bar 25.

Figure 5:
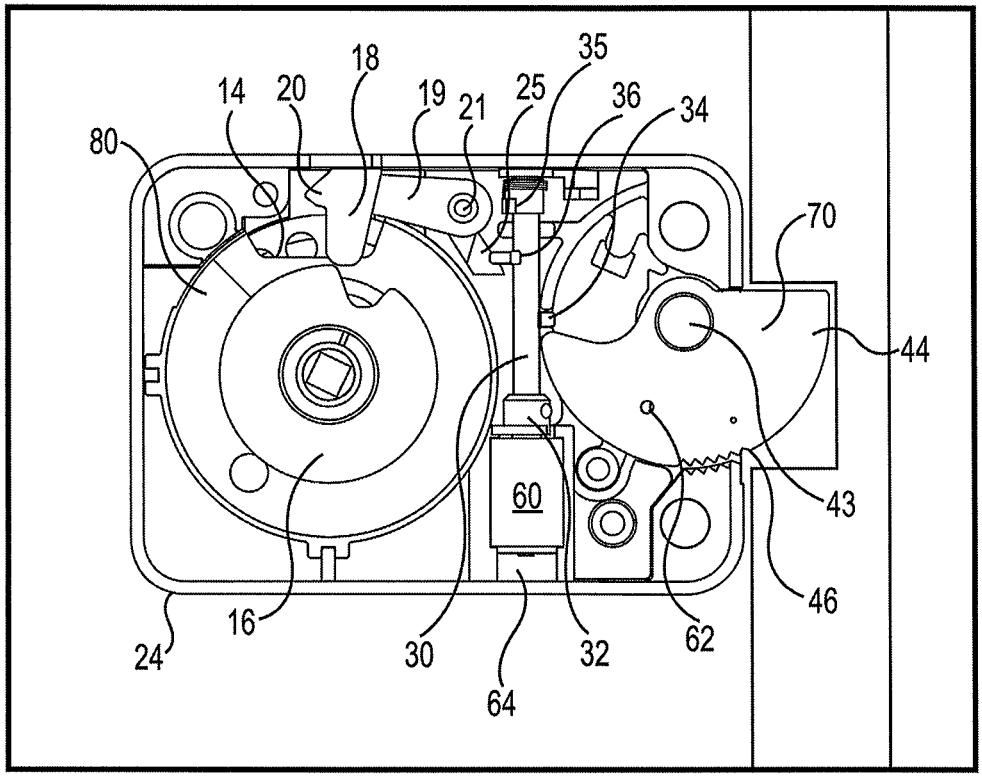
FIG. 5 is a top view of the lock in accordance with the invention showing the blocking member being rotated to disengage the locking bolt.
Figure 6:
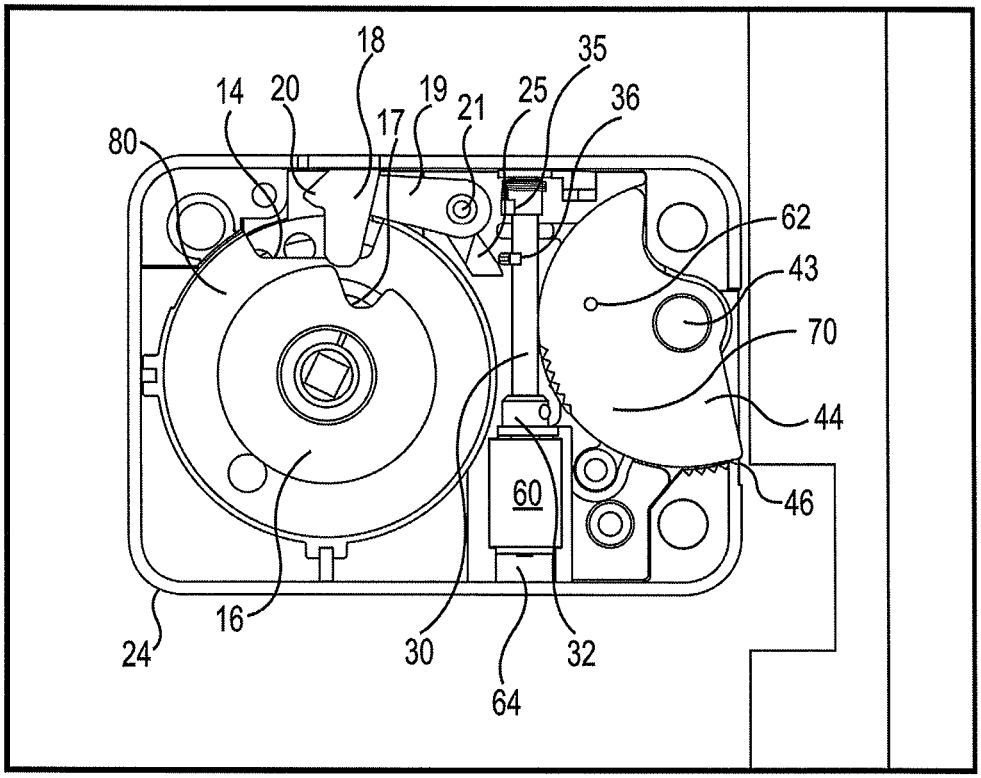
FIG. 6 is a top view of the lock in accordance with the invention showing the locking bolt in the unlocked position.
Figure 7:
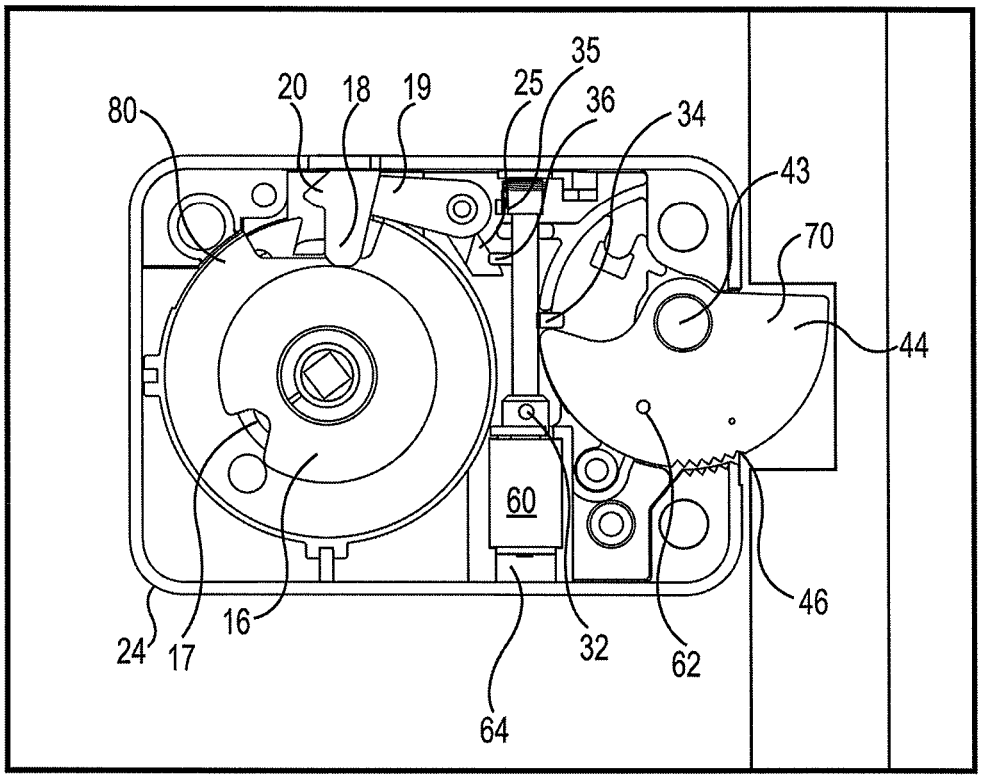
FIG. 7 is a top view illustrating the mechanical mode and showing the back wheel with corresponding gate rotated to the open position.
Figure 8:
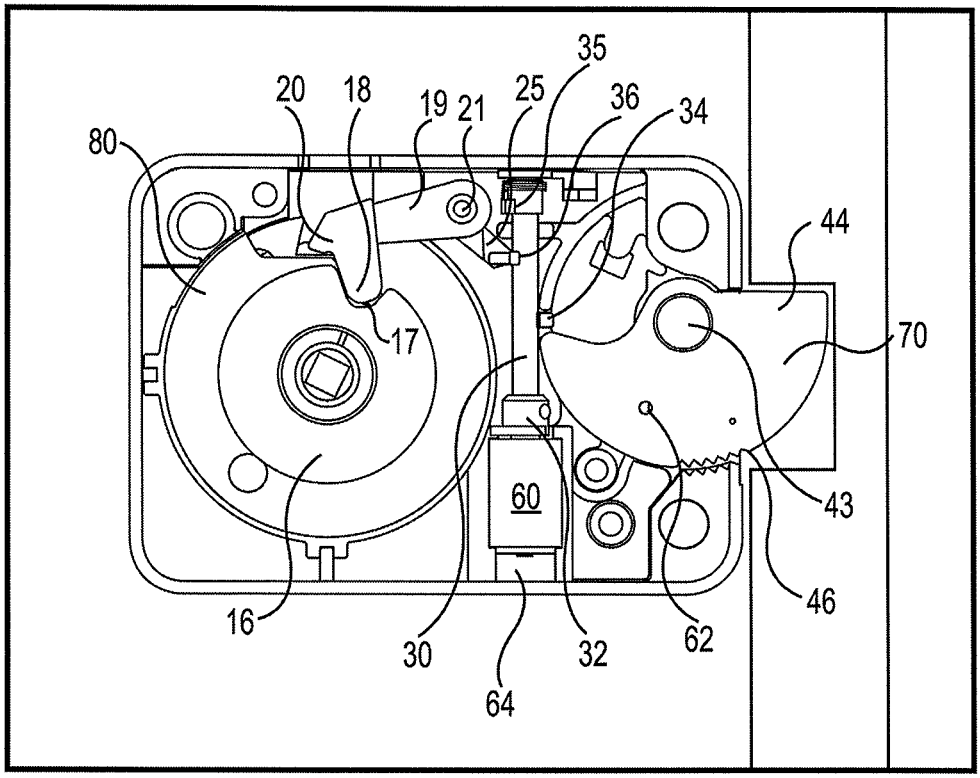
FIG. 8 is a top view showing the nose portion in engagement with the cam while back lever contacts and commences to cause the armature post to rotate such that the blocking member disengages from the locking bolt.
Figure 9:
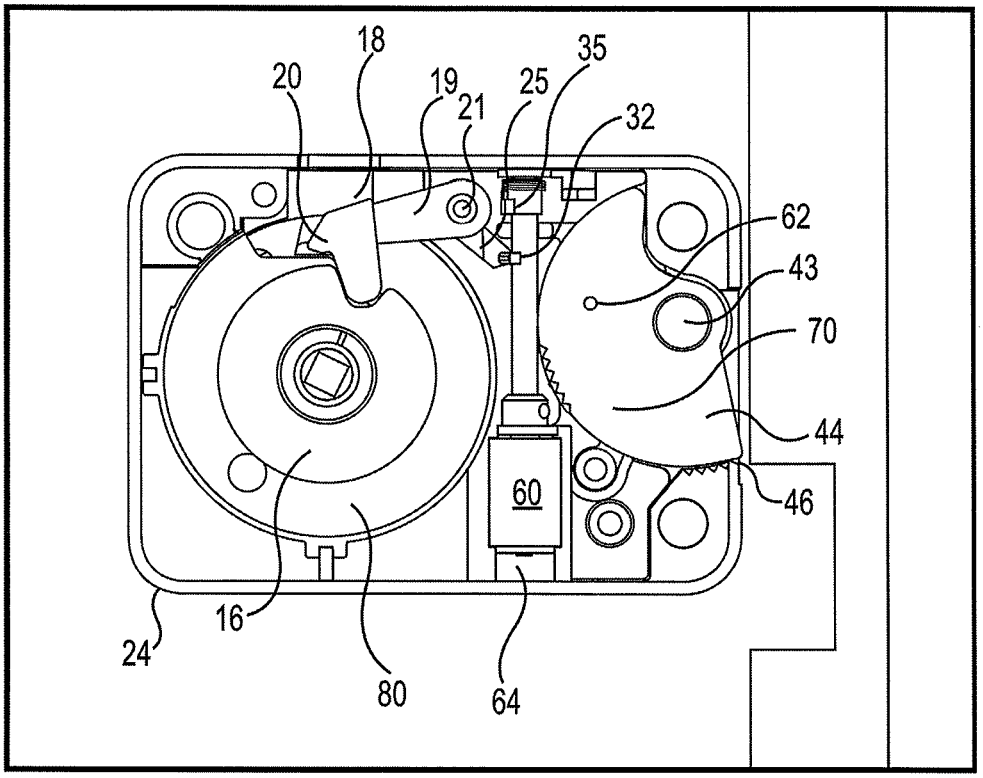
FIG. 9 is a top view showing the mechanical mode in the full open position with the locking bolt retracted.

Circuitry within a circuit board (not shown) cooperates with the combination entry device seen in FIG. 2. When the user enters the correct combination on electronic key pad 54, the circuitry signals solenoid 60 to rotate armature post 30 by a predetermined amount. As a result, the armature post 30 rotates by a predetermined amount while first outwardly extending member 34 simultaneously rotates by the same predetermined amount and disengages from lip 38 of locking bolt 70 as best seen in FIG. 5. Second outwardly extending member 34 is stopped by an engaging surface cast in housing 24. As first outwardly extending member 34 disengages from lip 38, locking bolt 70 rotates to the unlocked position by retracting into housing 24 as best seen in FIG. 6.

As noted above, electrical surges in the power line supplying power to the electronic lock can damage the circuitry making impossible the opening of the lock by the authorized user using the electronic key pad 54 of dial 50. In addition, malfunction of the electronic circuitry could also result from tampering, or loss of power making opening of the lock impossible. In such a case the electronic and mechanical combination lock 10 in accordance with the invention includes a mechanically operated locking mechanism 80 operated by the manual lock portion 52 of dial 50.

Figure 3:
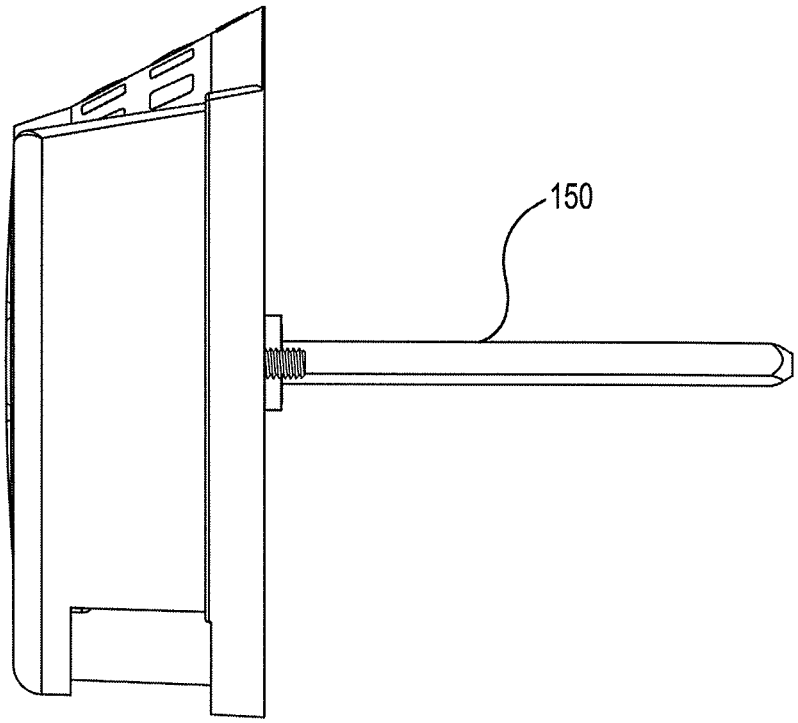
FIG. 3 is a side view of the dial of FIG. 1 showing a dial shaft that engages the lock on an opposite side of a container to be secured.

As previously noted, the mechanical locking mechanism a plurality of gated tumbler wheels 13 each having a gate 14 thereon, are provided within the lock housing 24 in a manner to be manipulated by the mechanical portion 52 of dial 50, seen in FIG. 2, via the dial shaft 15 seen in FIG. 3.

A cam wheel 16 which engages with dial shaft 15 is provided with a cam way 17 which receives the nose portion 18 of bolt release lever 19 when the associated fence 20 (best seen in FIGS. 4-9) is received in the aligned gates 14 of the tumbler wheels 13. The bolt release lever 19 is pivotally connected at its second end by pin 21 to housing 24.

In operation, a user enters the correction combination by dialing the combination on dial 52. As the correct combination is entered, the plurality of gated tumbler wheels rotate and align. When the associated fence is received in the aligned gates of the tumbler wheel the nose 18 of the bolt release lever 19 is received in the cam way 17. As the nose 18 of the bolt release lever 19 is received in the cam way 17, locking bar 25 of bolt release lever 19 moves downwardly and contacts the second outwardly extending member 36 on the armature post 30 which in turn causes armature post 30 to rotate to the unblocking position. As armature post 30 rotates, the first outwardly extending member 34 rotates behind the lip 38 of the locking bolt. A user turns the handle on the safe door (or other container being secured) which retracts the locking bolt 44 into housing 24.

Although the present invention has been described with reference to certain aspects and embodiments, those of ordinary skill in the art will appreciate that changes may be made in form and detail without departing from the spirit and scope of the invention.

I claim:

1. A lock comprising:

a housing having an opening for receiving a locking bolt being movable between a locked position and an unlocked position;

a dual input dial having an electronic digital keypad for electronic entry of a combination and a mechanical dial for manual entry of a combination;

a rotary actuator having a rotary output positioned within the housing and energizable between a locked condition for maintaining the locking bolt in the locked position and an unlocked condition that allows the locking bolt to move to the unlocked position;

a cam wheel operably coupled to said housing, said cam wheel including a cam way;

a bolt release lever moveably coupled to said housing, said bolt release lever having a nose portion engageable with said cam way and a locking bar; and a single armature post responsive to both an input of the electronic entry of the electronic combination input and the manual combination input of the manual combination, the single armature post coupled to the rotary actuator and rotatably responsive to the rotary output of the rotary actuator, said armature post including first and second outwardly extending flanges, said first outwardly extending flange normally biased in a blocking position by engaging a tip of the locking bolt to block said locking bolt from being moved to the unlocked position, wherein the electronic entry of the combination actuates the rotary actuator and causes said armature post to rotate by a predetermined amount in which the first outwardly extending flange rotatably moves from the blocking position to an unblocking position allowing said locking bolt to move into said unlocked position, and further wherein upon mechanical entry of the combination said nose portion engages said cam way and causes the locking bar to move downward by a predetermined amount thereby causing said second outwardly extending flange to rotatably move and cause said first outwardly extending flange to rotatably move from the blocking position to an unblocking position allowing said locking bolt to move into said unlocked position.

2. The lock of claim 1 wherein said locking bolt is a rotary locking bolt.

3. The lock of claim 1 wherein said rotary actuator is a rotary electromagnetic device.

4. The lock of claim 3 wherein said rotary electromagnetic device is a rotary solenoid.

5. The lock of claim 1 further comprising a first spring coupled to said housing and said locking bolt for biasing said locking bolt in said locked condition.

6. The lock of claim 1 further comprising a second spring positioned between the rotary actuator and the armature post for biasing the armature post in the blocking position.

7. The lock of claim 1 wherein in the blocking position said first outwardly extending flange is in blocking contact with said locking bolt.

8. The lock of claim 1 wherein the rotary locking bolt further comprises a tamper resistant mechanism comprising a plurality of teeth in the rotary locking bolt and a plurality of corresponding teeth in the housing, wherein attempting to forcibly rotate the rotary locking bolt from the locked position to the unlocked position while the rotary actuator is in the locked condition causes the plurality of teeth on the rotary locking bolt to engage with the teeth in the housing thereby preventing unauthorized entry.

9. A lock comprising:

a housing having a cavity with first and second opposing side walls and an opening for receiving a rotary locking bolt, the rotary locking bolt moveable between a locked position and an unlocked position;

a rotary actuator having a rotary output of a predetermined amount and responsive to entry of an electronic combination input by a user;

a cam wheel operably coupled to said housing and responsive to a manual combination input of the user, said cam wheel including a cam way;

a bolt release lever moveably coupled to said housing, said bolt release lever including a nose portion engageable with said cam way and a locking bar; and a single armature post rotatably responsive to both the entry of the electronic combination input and the manual combination input, said armature post rotatably moveable between a blocking position that engages a tip of said locking bolt in the locked position and an unblocking position in which the armature post rotatably moves by a predetermined amount and disengages the tip of said locking bolt for allowing said locking bolt to move into said unlocked position.

10. The lock of claim 9 wherein said armature post includes a first blocking member responsive to said rotary output for blocking said rotary locking bolt in the locked position and a second outwardly extending flange member rotatably responsive to a downward movement of said bolt release lever to cause said first blocking member to move to the unblocking position.

11. The lock of claim 9 wherein said actuator is a rotary solenoid.

12. The lock of claim 9 wherein said armature post is biased in the blocking position.

13. The lock of claim 9 further comprising a first spring coupled to said housing and said rotary locking bolt for biasing said rotary locking bolt in said locked condition.

14. The lock of claim 9 further comprising a second spring positioned between the rotary actuator and the armature post for biasing the armature post in the blocking position.

15. The lock of claim 9 wherein the locking bolt further comprises a tamper resistant mechanism comprising a plurality of teeth in the locking bolt and a plurality of corresponding teeth in the housing, wherein attempting to forcibly rotate the locking bolt from the locked position to the unlocked position while the actuator is in a locked condition causes the plurality of teeth on the locking bolt to engage with the teeth in the housing thereby preventing unauthorized entry.

* * * * *